US011248305B2

(12) United States Patent
Omura et al.

(10) Patent No.: US 11,248,305 B2
(45) Date of Patent: Feb. 15, 2022

(54) COPPER ELECTROLYTIC PLATING BATH AND COPPER ELECTROLYTIC PLATING FILM

(71) Applicant: C. Uyemura & Co., Ltd., Osaka (JP)

(72) Inventors: Naoyuki Omura, Osaka (JP); Yuki Itakura, Osaka (JP); Kazunari Kato, Osaka (JP); Raihei Ikumoto, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 306 days.

(21) Appl. No.: 15/955,825

(22) Filed: Apr. 18, 2018

(65) Prior Publication Data

US 2018/0305833 A1 Oct. 25, 2018

(30) Foreign Application Priority Data

Apr. 20, 2017 (JP) ..... JP2017-083861
Feb. 14, 2018 (JP) ..... JP2018-024065

(51) Int. Cl.
*C22C 9/00* (2006.01)
*C25D 3/38* (2006.01)
*C25D 7/00* (2006.01)

(52) U.S. Cl.
CPC ..... *C25D 3/38* (2013.01); *C22C 9/00* (2013.01); *C25D 7/00* (2013.01)

(58) Field of Classification Search
CPC .... C25D 3/38; C25D 3/58; C25D 7/00; C22C 9/00
See application file for complete search history.

(56) References Cited

U.S. PATENT DOCUMENTS 7,938,948 B2 * 5/2011 Tsuji ..... C25D 3/46 205/242
2003/0000846 A1 1/2003 Rzeznik et al.
(Continued)

FOREIGN PATENT DOCUMENTS

CN 1652310 8/2005
CN 1662679 B * 6/2010 ..... C25D 17/10
(Continued)

OTHER PUBLICATIONS

Office Action dated Apr. 20, 2021, in corresponding Taiwanese Patent Application No. 107108192, with English translation.
(Continued)

*Primary Examiner* — Daniel J. Schleis
*Assistant Examiner* — Kevin C T Li
(74) *Attorney, Agent, or Firm* — Wenderoth, Lind & Ponack, L.L.P.

(57) ABSTRACT

The present invention provides a technology for, in copper electrolytic plating containing silver ions as an alloy component, obtaining a copper electrolytic plating film in which co-deposition of sulfur can be significantly suppressed and which is excellent in physical properties such as strength and hardness even after a high-temperature heat treatment at about 200° C. or higher. The present invention is a copper electrolytic plating bath comprising copper ions, an acid, chloride ions, and a complexing agent, wherein the copper electrolytic plating bath further comprises silver ions as an alloy component, and wherein methionine or a derivative thereof is contained as the complexing agent.

3 Claims, 4 Drawing Sheets

(56) References Cited

U.S. PATENT DOCUMENTS

| | | | | |
|---|---|---|---|---|
| 2003/0201536 | A1 | 10/2003 | Ueno | |
| 2005/0140013 | A1 | 6/2005 | Ueno | |
| 2005/0196959 | A1 | 9/2005 | Ueno | |
| 2011/0089044 | A1 * | 4/2011 | Isono | H05K 3/423 205/298 |

FOREIGN PATENT DOCUMENTS

| | | | |
|---|---|---|---|
| JP | 11-204524 | | 7/1999 |
| JP | 2002-294488 | | 10/2002 |
| JP | 2006265632 | A * | 10/2006 |
| JP | 2007-138265 | | 6/2007 |
| JP | 2011-84779 | | 4/2011 |

OTHER PUBLICATIONS

Office Action dated May 7, 2021, in corresponding Chinese Patent Application No. 201810356034.2, with English translation.
Office Action dated Aug. 23, 2021, in corresponding Taiwanese Patent Application No. 107108192, with English translation.
Office Action dated Oct. 5, 2021, in corresponding Japanese Patent Application No. 2018-024065, with English Machine translation.

* cited by examiner

【FIG. 1】
(a) just after plating
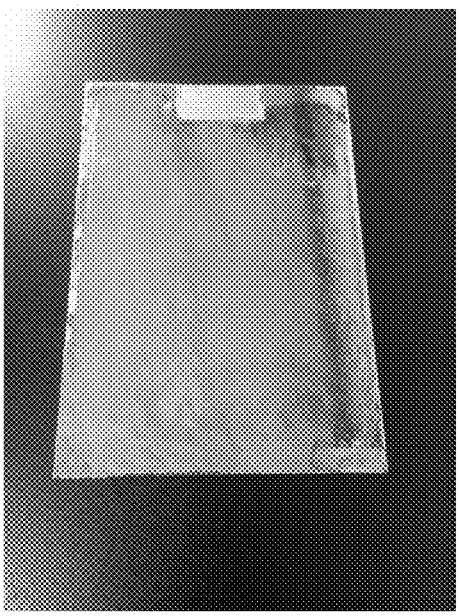
(b) peel off the film just after plating
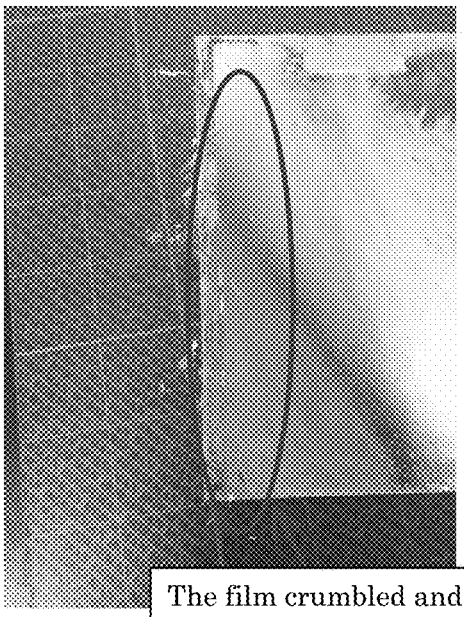
The film crumbled and dropped when peeling off the Stainless steel plate
(c) after heating at 230°C for 2 hours
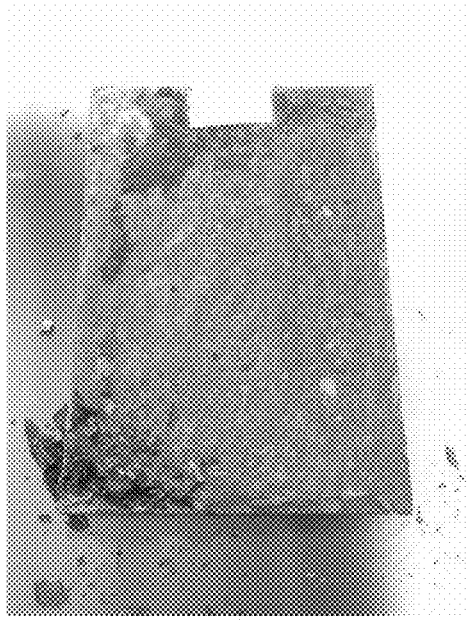

【FIG. 2】
(a) just after plating
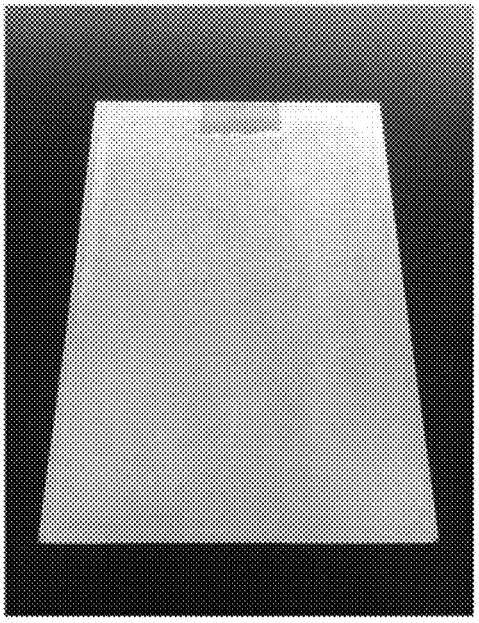
(b) peel of the film just after plating
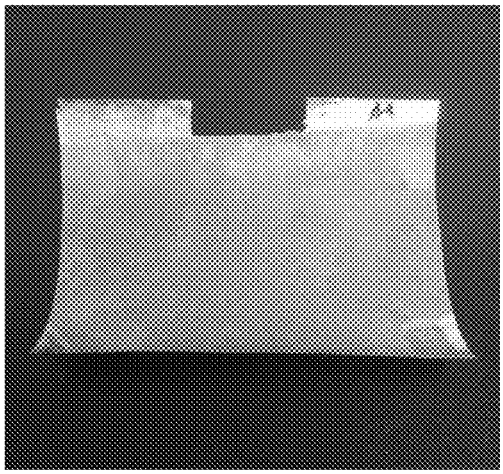

【FIG. 3】
| No.1<br>Copper plating film | No.2<br>Copper-silver plating film<br>(complexing agent:<br>thiourea) | No.3<br>Copper-silver plating film<br>(complexing agent:<br>DL-methionine) |
|---|---|---|
| 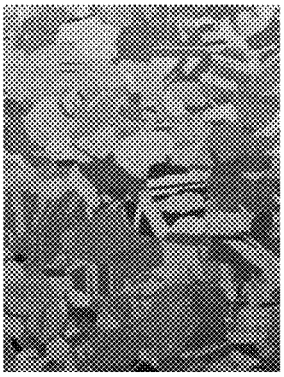 | 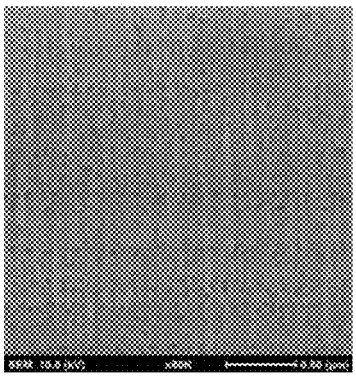 | 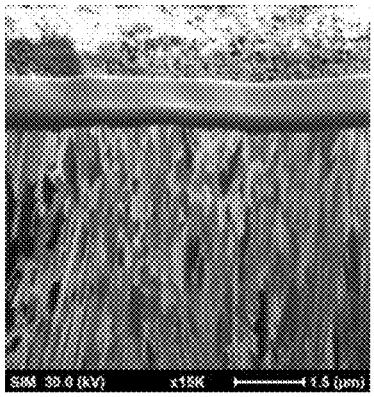 |
| Random orientation | Amorphous structure | Columnar structure |

【FIG. 4】
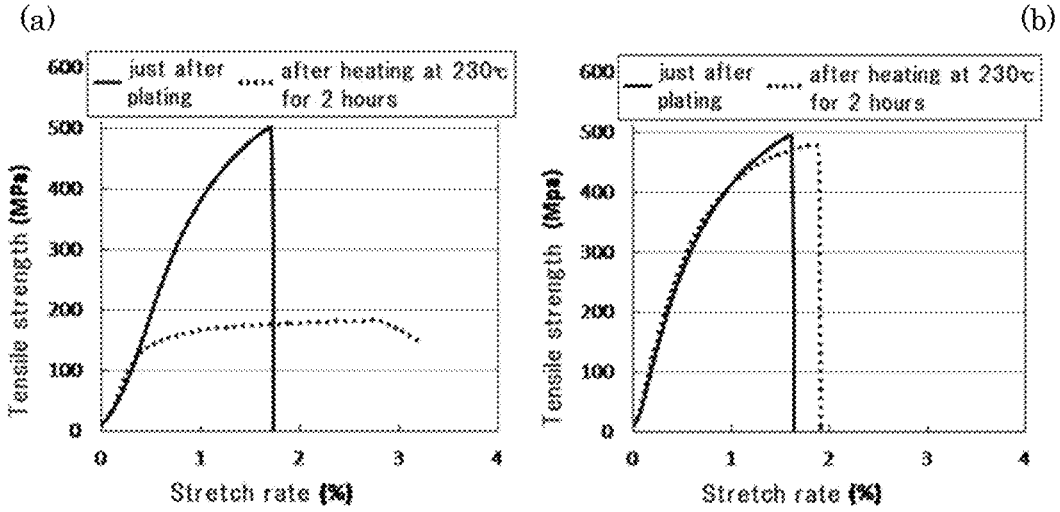
General copper plating film
Copper-silver plating film (using DL-methionine)

COPPER ELECTROLYTIC PLATING BATH AND COPPER ELECTROLYTIC PLATING FILM

TECHNICAL FIELD

The present invention relates to a copper electrolytic plating bath and a copper electrolytic plating film, and in particular, to a copper electrolytic plating bath and a copper electrolytic plating film that contain silver ions as an alloy component.

BACKGROUND ART

Copper has high thermal conductivity and high electrical conductivity and is excellent in malleability, and hence, copper electrolytic plating is widely used in the electronics industry as surface treatment for mounting portions, terminal portions, etc. of printed board circuits and IC packages (for example, Patent Documents 1 and 2). Various additives are added to a copper electrolytic plating bath, and chloride ions are added as an essential component for the purpose of, for example, smoothing a plating film. In recent years, with downsizing and higher density of electronic components, reduction in thickness of a copper plating film is required, and there is a strong demand for provision of a copper plating film with high strength even if it is thin.

In general, a copper plating film has a crystal structure just after plating. However, if the copper plating film is allowed to stand at room temperature after plating, recrystallization occurs in a few hours to several days, and the crystal size increases whereby the copper plating film softens. In particular, when performing re-wiring on a semiconductor wafer, a resin film composed of polyimide or the like may be stacked on a copper plating film and heated at a high temperature of 200° C. or higher for a long time. The recrystallization proceeds due to such a high-temperature heat treatment, and the hardness and the tensile strength of the copper plating film significantly decreases, causing a problem that the copper plating film breaks due to occurrence of cracks or the like.

For the purpose of preventing the recrystallization of copper, copper alloy plating to which an alloy component is added has been proposed, and for example, may include copper-silver alloy plating to which silver is added as an alloy component. In electrolytic plating containing silver, silver chloride is generally precipitated by a reaction with chloride ions, and hence, in order to stabilize silver and prevent precipitation of silver chloride, a sulfur-based complexing agent exemplified by thiourea is added.

PRIOR ART DOCUMENT

Patent Documents

Patent Document 1: JP 2011-84779A
Patent Document 2: JP 2007-138265A

SUMMARY OF THE INVENTION

Problems to be Solved by the Invention

However, as a result of the study conducted by the present inventors, it has been made clear that when thiourea is used as a complexing agent in a copper-silver alloy plating bath, sulfur is co-deposited in the plating film, causing deterioration of physical properties, corrosion resistance, and the like of the plating film.

The present invention has been made in view of the above situation, and an object thereof is to provide a technology for, in copper electrolytic plating containing silver ions as an alloy component, obtaining a copper electrolytic plating film in which co-deposition of sulfur can be significantly suppressed and which is excellent in physical properties such as strength and hardness even after a high-temperature heat treatment at about 200° C. or higher.

Means for Solving the Problem

The constitution of the present invention is as follows.

1. A copper electrolytic plating bath comprising copper ions, an acid, chloride ions, and a complexing agent, wherein the copper electrolytic plating bath further comprises silver ions as an alloy component, and wherein methionine or a derivative thereof is contained as the complexing agent.

2. A copper electrolytic plating film comprising silver in amount of 0.1 to 20 mass % and sulfur in amount of 1 mass % or less in the electrolytic plating film.

3. The copper electrolytic plating film according to above 2 comprising a columnar crystal.

4. The copper electrolytic plating film according to above 2 or 3, having a hardness of 150 Hv or more in terms of Vickers hardness and a tensile strength of 300 MPa or more, after heating at 230° C. for 2 hours.

5. An electronic device component comprising the copper electrolytic plating film according to any one of above 2 to 4.

Effects of the Invention

According to the present invention, it is possible to provide a copper electrolytic plating film containing silver ions as an alloy component in which co-deposition of sulfur can be significantly suppressed and which is excellent in physical properties such as strength and hardness even after a high-temperature heat treatment at about 200° C. or higher.

BRIEF DESCRIPTION OF THE DRAWINGS

FIG. 1 shows photographs of the film appearances of No. 2 (the comparative example using thiourea as a complexing agent) in Table 1.

FIG. 2 shows photographs of the film appearances of No. 3 (the example of the present invention using methionine as specified in the present invention as a complexing agent) in Table 1.

FIG. 3 shows FIB-SIM photographs of crystal structures after heat treatment of Nos. 1 to 3 in Table 1.

FIG. 4 shows graphs of the tensile test results of Nos. 1 and 3 in Table 1.

MODE FOR CARRYING OUT THE INVENTION

The inventors made intensive studies, in electroplating using a copper electrolytic plating bath that contains silver as an alloy component (hereinafter may be referred to as "copper-silver alloy plating bath"), to provide a copper-silver alloy plating bath in which precipitation of silver chloride, silver, and the like can be prevented, and sulfur is not co-deposited in a resulting copper electrolytic plating film (hereinafter may be referred to as "copper-silver alloy plating film") so that the sulfur concentration in the plating film is remarkably reduced, whereby the plating film that is excellent in mechanical properties such as strength and hardness even after a high-temperature heat treatment can be obtained.

As the result, the inventors have found that a desired copper-silver alloy plating film can be obtained by using a copper-silver alloy plating bath containing methionine or a derivative thereof, without using thiourea, as a complexing agent. The above-mentioned copper-silver alloy plating film is excellent in mechanical properties such as hardness and tensile strength even after a high-temperature heat treatment at 200° C. or higher, and hence, is suitably used for all components for electronic devices such as semiconductor packages and printed boards.

First, the process of arriving at the present invention will is described below.

Using a copper-silver alloy plating solution, the present inventors have first studied the relation between a complexing agent commonly used in an electrolytic plating bath and silver chloride.

Specifically, various non-sulfur complexing agents shown below were dissolved in a copper-silver alloy plating solution having the following composition at a concentration of 1 to 50 g/L. Then, HCl was added to the solution as chloride ions such that the chloride ion concentration became 30 mg/L, and a visual observation was made to see whether precipitation of silver chloride was produced. As a result, it has been proven that even when these non-sulfur complexing agents are added, white precipitate of silver chloride is produced upon addition of HCl.

(Copper-Silver Alloy Plating Solution)

$CuSO_4.5H_2O$=Mixture solution of (100 g/L, $H_2SO_4$=150 g/L), and ($Ag_2SO_4$=0.1 g/L)

(Type of Complexing Agent)

2-phosphonobutane-1,2,4-tricarboxylic acid, sodium gluconate, nitrilotriacetic acid, diethylenetriaminepentaacetic acid, N-(2-hydroxyethyl)ethylenediamine-N,N',N'-triacetic acid, triethylenetetraaminehexaacetic acid, 1,3-diamino-2-propanol-N,N,N',N'-tetraacetic acid, N-(2-hydroxyethyl) iminodiacetic acid, N,N-dihydroxyethylglycine, L-tetrasodium glutamate diacetate, trisodium ethylenediamine disuccinate, malonic acid, succinic acid, oxalic acid 2K, adipic acid, maleic acid, potassium hydrogen phthalate, 2-aminothiazole, 2,2'-dipyridyl disulfide, and 5,5-dimethylhydantoin.

Next, the presence or absence of precipitation of silver chloride was observed in the same manner as above except that a sulfur-based complexing agent of sodium thiosulfate, which is commonly used in a copper-silver electrolytic plating bath, was used as a complexing agent at a concentration of 0.1 to 5 g/L. As a result, when sodium thiosulfate was used as a complexing agent, white precipitation of silver chloride was not confirmed upon addition of HCl, but gray precipitation of silver was produced when allowed to stand at room temperature for one day.

Next, the presence or absence of precipitation of silver chloride was observed in the same manner as above except that a sulfur-based complexing agent of thiourea, DL-methionine, or L-methionine was used as a complexing agent at a concentration of 1 to 50 g/L. As a result, in any cases that these complexing agents were used, no precipitation of silver chloride, silver and the like was produced even when allowed to stand for one day after addition of HCl.

These experimental results show that the use of thiourea or methionine as a complexing agent is effective for preventing precipitation of silver chloride or the like produced when a copper-silver electrolytic plating bath is used.

However, according to the results of studies made by the present inventors, it has been proven that, among these, when thiourea is used, a brittle film is formed immediately after plating, and that this problem becomes more significant by a high-temperature heat treatment at 230° C. for 2 hours, so that the film becomes further brittle (see the examples described later). The reason therefor is considered that sulfur is co-deposited in an amount of about several % in the copper-silver alloy plating film by the use of thiourea, and as a result, sulfur embrittlement occurs. From the results of studies made by the present inventors, it has been revealed for the first time that even when thiourea is added as a complexing agent to the copper-silver alloy plating bath as in the conventional methods, plating films having high hardness and high strength that are suitable for electronic device components such as semiconductor wafers can never be obtained.

On the other hand, it has been revealed that when methionine is used as a complexing agent, recrystallization is unexpectedly suppressed after allowed to stand at room temperature and even after heated at a high temperature of 230° C. for 2 hours, and hence, columnar crystals immediately after plating can be maintained. In addition, it has been revealed that the above-described problem due to sulfur embrittlement is not observed at all, whereby a plating film having high hardness and high strength is obtained even after a high-temperature heat treatment (see the examples described later). Although the detailed mechanism by which such effects are achieved is not clear, it is assumed that, for example, when methionine is used, sulfur embrittlement does not occur since the amount of sulfur co-deposited in the plating film is small, and silver co-deposited in the copper plating film plays a role as a pinning effect to suppress recrystallization.

In the examples described later, although experiments were conducted using methionine and isomers thereof, it has been confirmed that similar results can be obtained even using a methionine derivative having a substituent in a side chain of methionine.

Hereinafter, the present invention will be described in detail.

(Copper Electrolytic Plating Bath of the Present Invention)

The copper electrolytic plating bath of the present invention contains copper ions, an acid, chloride ions, and a complexing agent, and is characterized by further containing silver ions as an alloy component, and containing methionine or a derivative thereof as the complexing agent.

Of these, the copper ions serve as a source to obtain a copper plating. Examples of a copper ion source compound include water-soluble copper salts such as copper sulfate, copper oxide, and copper methanesulfonate. The compound for supplying copper ions may be added singly or used in combination of two or more.

The concentration of the copper ions contained in the plating bath is preferably 5 to 90 g/L, and more preferably 7.5 to 75 g/L. If the concentration is less than 5 g/L, there arise problems such as burnt deposit. On the other hand, if the concentration exceeds 90 g/L, there arise problems such as crystal precipitation of a copper salt and an increase in cost. For example, a copper sulfate is preferably contained at a concentration equivalent to 30 to 300 g/L as calculated for copper sulfate pentahydrate.

The acid is added for the purpose of improving the electrical conductivity and the uniformity of a plating solution. Examples of the acid include inorganic acids such as sulfuric acid, and organic acids such as methanesulfonic acid and carboxylic acid. The compound for supplying the acid may be added singly or used in combination of two or more.

The concentration of the acid contained in the plating bath is preferably 1 to 300 g/L, and more preferably 10 to 250 g/L. If the concentration is less than 1 g/L, there arise problems such as an increase in voltage. On the other hand, if the concentration exceeds 300 g/L, costs increase.

The chloride ions are useful as a smoothing agent. Examples of a chloride ion source compound include, though not limited thereto, hydrochloric acid, ammonium chloride, sodium chloride, potassium chloride, cationic surfactants (including cationic dyes) which contain chloride ions, oxochlorides and the like. The compound for supplying the chloride ions may be added singly or used in combination of two or more.

The concentration of the chloride ions (when added singly, the concentration thereof, and when used in combination of two or more, the total concentration of those) contained in the plating bath is preferably 0.1 to 150 mg/L, and more preferably 0.5 to 100 mg/L. If the concentration is less than 0.1 mg/L, appearance deteriorates. On the other hand, if the concentration exceeds 150 mg/L, there arise problems such as passivation on a phosphorus-containing copper anode.

The silver ions are added as an alloy component. Examples of a silver ion source compound include such as silver sulfate and silver nitrate. The compound for supplying the silver ions may be added singly or used in combination of two or more.

The concentration of the silver ions (when added singly, the concentration thereof, and when used in combination of two or more, the total concentration of those) contained in the plating bath is preferably 0.7 to 700 mg/L, and more preferably 4 to 600 mg/L. If the concentration is less than 0.7 mg/L, a sufficient amount of silver is not co-deposited in the plating film. On the other hand, if the concentration exceeds 700 mg/L, costs increase.

In terms of a relationship with the above-described copper ions, the silver ions are preferably contained in the range of 12:1 to 220000:1, and more preferably 25:1 to 30000:1 in molar ratio relative to the copper ions.

The present invention is characterized by using methionine or a derivative thereof as the complexing agent. By using these compounds, sulfur embrittlement does not occur, the crystal state immediately after plating can be maintained even after a high-temperature heat treatment, and a plating film with high hardness and high strength can be obtained. These compounds may be used singly or in combination of two or more.

Methionine also includes isomers of methionine, and as examples thereof, DL-methionine, D-methionine, and L-methionine can be given.

As examples of the methionine derivative, the methionine derivatives having a substituent in an amino group moiety, a carboxy moiety, a sulfur moiety or the like constituting methionine can be given, and isomers thereof are also included. Moreover, salts thereof are also included. Specific examples thereof include N-acetyl-DL-methionine, N-acetyl-L-methionine, DL-alanyl-DL-methionine, benzoyl-DL-methionine, N-(tert-butoxycarbonyl)-D-methionine, N-(tert-butoxycarbonyl)-L-methionine, N-(tert-butoxycarbonyl)-L-methionine N-succinimidy, N-carbobenzoxy-DL-methionine, N-carbobenzoxy-D-methionine, N-carbobenzoxy-L-methionine, dabsyl-L-methionine, N-(2,4-dinitrophenyl)-L-methionine dicyclohexylammonium, N-[(9H-fluoren-9-ylmethoxy)carbonyl]-D-methionine, N-[(9H-fluoren-9-ylmethoxy)carbonyl]-L-methionine, N-formyl-L-methionine, L-methionine methyl hydrochlorid, DL-methionine methylsulfonium chloride, DL-methionine sulfone, DL-methionine sulfoxide, phenylthiohydantoin-methionine, DL-selenomethionine, L-selenomethionine, and the like.

The concentration of methionine or the methionine derivative (when added singly, the concentration thereof, and when used in combination of two or more, the total concentration of those) contained in the plating bath is preferably 0.01 to 300 g/L, and more preferably 0.05 to 100 g/L in terms of methionine. If the concentration is less than 0.01 g/L, silver chloride easily precipitates. On the other hand, if the concentration exceeds 300 g/L, there arise problems such as precipitation of a methionine crystal.

In the present invention, it is sufficient that at least methionine or the methionine derivative (hereinafter sometimes collectively referred to as methionines) is contained as a complexing agent. Other complexing agents than methionines may be further contained as long as they do not adversely affect the performance of the plating solution. That is, in the present invention, as a complexing agent, methionines may be used singly, or methionines and other complexing agents may be used in combination.

The types of "other complexing agents" used in the present invention are not particularly limited as long as they are usually used in the field of electroplating, and examples thereof include the above-mentioned thiourea, a thiol compound and the like. These may be used singly or in combination of two or more. The concentration of the above other complexing agents (when used singly, the concentration thereof, and when used in combination of two or more, the total concentration of those) in the copper electrolytic plating solution is preferably 0.01 g/L or more, more preferably 0.05 g/L or more, further preferably 0.1 g/L or more, and still further preferably 0.5 g/L or more; preferably 300 g/L or less, more preferably 200 g/L or less, further preferably 100 g/L or less, and still further preferably 50 g/L or less.

The copper-silver plating bath of the present invention may further contain the following components in addition to the above-mentioned components. As for the following components, for example, reference can be made to a brightener and the like described in the above-mentioned Patent Document 2.

The brightener is added as a plating accelerator to obtain a glossy plating film. In the present invention, it is preferable to use a sulfur-containing organic compound as the brightener, and the following examples can be given. These compounds may be used singly or in combination of two or more. However, usable compounds are not limited thereto, and those commonly used in the technical field of the present invention can be used.

$$R1\text{-}S\text{—}(CH_2)n\text{-}(O)p\text{-}SO_3M$$

$$(R2)_2N\text{—}CSS\text{—}(CH_2)n\text{-}(CHOH)p\text{-}(CH_2)n\text{-}(O)p\text{-}SO_3M$$

$$R2\text{-}O\text{—}CSS\text{—}(CH_2)n\text{-}(CHOH)p\text{-}(CH_2)n\text{-}(O)p\text{-}SO_3M$$

wherein R1 represents a hydrogen atom or a group represented by —(S)m-$(CH_2)$n-(O)p-$SO_3$M, R2 represents an alkyl group having 1 to 5 carbon atoms, M represents a hydrogen atom or an alkali metal, m is 0 or 1, n is an integer of 1 to 8, and p is 0 or 1.

The concentration of the brightener contained in the plating bath is preferably 0.01 to 1000 mg/L, and more preferably 0.5 to 500 mg/L. If the concentration is less than 0.01 mg/L, sufficient gloss cannot be achieved. On the other hand, if the concentration exceeds 1000 mg/L, appearance deteriorates.

A carrier is added as a plating inhibitor. In the present invention, it is preferable to use a polyether compound as the carrier, and as examples thereof, a compound containing a polyalkylene glycol having 4 or more —O— linkages can be given. Examples of the polyalkylene glycol include polyethylene glycol, polypropylene glycol, copolymers thereof, polyethylene glycol fatty acid esters, polyethylene glycol alkyl ethers, and the like. These compounds may be used singly or in combination of two or more. However, usable compounds are not limited thereto, and those commonly used in the technical field of the present invention can be used.

The concentration of the carrier contained in the plating bath is preferably 5 to 5000 mg/L, and more preferably 10 to 3000 mg/L. If the concentration is less than 5 mg/L, there arise problems such as nodules. On the other hand, if the concentration exceeds 5000 mg/L, costs increase.

A leveler is added to obtain levelling property since the leveler functions as a cation in an acidic bath, and is electrically concentrated into high-charged areas, thereby suppressing the deposition of the plating film. In the present invention, it is preferable to use a nitrogen-containing organic compound as the leveler. Specific examples thereof include such as polyethyleneimine and derivatives thereof, polyvinyl imidazole and derivatives thereof, polyvinyl alkylimidazole and derivatives thereof, copolymers of vinyl pyrrolidone and vinyl alkylimidazole or derivatives thereof, dyes such as janus green B, a diallyldimethylammonium chloride polymer, a diallyldimethylammonium chloride-sulfur dioxide copolymer, a partial 3-chloro-2-hydroxypropylated diallylamine hydrochloride-diallyldimethylammonium chloride copolymer, a diallyldimethylammonium chloride-acrylamide copolymer, a diallylamine hydrochloride-sulfur dioxide copolymer, an allylamine hydrochloride polymer, an allylamine (free) polymer, an allylamine hydrochloride-diallylamine hydrochloride copolymer, a polymer of diamine and epoxy, a polymer of morpholine and epichlorohydrin, and an epichlorohydrin modified product of a polycondensation product of diethylentriamine, adipic acid and ε-caprolactam. These compounds may be used singly or in combination of two or more. However, usable compounds are not limited thereto, and those commonly used in the technical field of the present invention can be used.

The concentration of the leveler contained in the plating bath is preferably 0.01 to 3000 mg/L, and more preferably 0.05 to 2000 mg/L. If the concentration is less than 0.01 mg/L, sufficient leveling cannot be achieved. On the other hand, if the concentration exceeds 3000 mg/L, costs increase.

In addition to the above components, additives such as surfactants may be added for improving properties such as permeability within a range which does not impair the advantageous effects of the invention.

The present invention is characterized by using the above-described plating bath. The conditions for electroplating are not particularly limited, and a commonly used method may be adopted. For example, the cathode current density is preferably in a range of 0.05 to 30 A/dm$^2$, and more preferably in a range of 0.05 to 20 A/dm$^2$. As the agitation method, a commonly used method may be applied, and for example, an aeration, a jet, a paddle, or the like may be used. A known anode may be used, and both a soluble anode such as a copper plate, and an insoluble anode may be used. The plating temperature is preferably 15 to 50° C. and, and more preferably 22 to 40° C.

The type of a substrate to be plated (an object to be plated) is not particularly limited, and examples thereof include conductive materials such as metals such as copper and a copper alloy, and a combination of these conductive materials and insulating materials such as ceramics, glass, plastics and ferrite. The substrate is preferably subjected to plating treatment after performing a suitable pretreatment such as a degreasing treatment and an activation treatment.

The plating bath of the present invention can be generally used in applications in which electroplating is performed. As the applications, wafers, printed boards, semiconductor packages, chip components, bumps, ornamental plating, rustproof plating, lead frames, electronic components, connectors, ferrite, electroforming, vehicle-related components, and the like can be exemplified.

(Plating Film of the Present Invention)

In the copper-silver alloy plating film of the present invention, the silver content is 0.1 to 20 mass %, and the sulfur content is 1 mass % or less, in the plating film. The silver content is preferably 0.2 to 10 mass %.

The plating film of the present invention is characterized in that the sulfur content is reduced to 1 mass % or less. As described above, when a complexing agent such as thiourea is used, sulfur is co-deposited in an amount of about several % in the plating film. However, according to the present invention, it is possible to suppress a co-deposition amount of sulfur to a detection lower limit or below of an analyzer (energy dispersive X-ray spectroscopy (EDS) in the examples described later). The smaller sulfur content is more preferable, and it was possible to suppress the sulfur content to the detection lower limit concentration (0.2 mass %) or less of the EDS analyzer in the examples described later.

The plating film of the present invention is excellent in hardness and strength after a high-temperature heat treatment. It is preferable that after heating at 230° C. for 2 hours, the plating film satisfy a hardness of 150 Hv or more in terms of Vickers hardness and a tensile strength of 300 MPa or more. It is more preferable that after heating at 230° C. for 2 hours, the plating film have a hardness of 180 Hv or more and a tensile strength of 400 MPa or more. Methods for measuring the hardness and the tensile strength are described in detail in the following examples.

Since the plating film of the present invention contains silver, the crystalline state immediately after plating can be maintained. After allowing the plating film to stand at room temperature, and further even after a high-temperature heat treatment, columnar crystals immediately after plating are still present in the plating film. Here, the columnar crystal refers to a crystalline structure in which when the average value of the length in the film thickness direction of the plating film is "a", and the average value of the length (width) in the direction perpendicular to the film thickness direction of the plating film is "b", the average aspect ratio of a/b is more than one.

(Electronic Device Components)

Electronic device components having the above-described plating film are also included in the present invention. As the electronic device components, components constituting electronic devices such as chip components, crystal oscillators, bumps, connectors, lead frames, hoops, semiconductor packages, and printed boards can be exemplified.

This application claims the benefit of priority to Japanese Patent Application No. 2017-83861, filed on Apr. 20, 2017 and Japanese Patent Application No. 2018-24065, filed on Feb. 14, 2018. The entire contents of the specifications of Japanese Patent Application No. 2017-83861, filed on Apr. 20, 2017 and Japanese Patent Application No. 2018-24065, filed on Feb. 14, 2018 are incorporated herein by reference.

EXAMPLES

Hereinafter, the present invention will be specifically described with reference to examples, but the invention is not limited to the following examples and can be carried out by appropriate modifications within a range adaptable to the above-mentioned and the later-described purposes, and all the modifications are encompassed within the technical scope of the invention. In the following, unless specified otherwise, the term "%" means "mass %".

In this example, using a copper plating bath (without the addition of an alloy component and a complexing agent, the conventional example), and a copper-silver alloy plating bath [with the use of thiourea as a complexing agent (the comparative example); or with the use of DL-methionine, N-acetyl-DL-methionine, or DL-methionine sulfoxide (the examples of the present invention)], various properties were examined when electroplating was carried out as described below.

No. 1 (Conventional Example)

A copper plating solution having the following composition was prepared, and electroplating was carried out on a Stainless steel plate with the prepared copper plating solution using a small apparatus with a bath volume of 5 liters to obtain Sample No. 1 having a copper plating film with a thickness of 50 μm.

(Composition of Plating Solution)

$CuSO_4.5H_2O$=100 g/L, $H_2SO_4$=150 g/L, HCl as chloride ions (chloride ion concentration=30 mg/L), bis(3-sulfopropyl)disulfide=5 mg/L as a brightener, polyethylene glycol=300 mg/L as a carrier, and polyethyleneimine=0.2 mg/L as a leveler.

(Electroplating Conditions)

Cathode current density: 2 A/dm$^2$

Bath temperature: 25° C.

Plating time: 113 minutes

Agitation: air agitation

No. 2 (Comparative Example)

Sample No. 2 was obtained by carrying out electroplating in the same manner as in No. 1, except that thiourea=1 g/L as a complexing agent and $Ag_2SO_4$=0.1 g/L as an alloy component were added to prepare a copper-silver plating solution.

No. 3 (Example of the Present Invention)

Sample No. 3 having a copper-silver plating film with a thickness of 50 μm was obtained by carrying out electroplating in the same manner as in No. 2, except that DL-methionine=30 g/L was added instead of thiourea as a complexing agent.

No. 4 (Example of the Present Invention)

Sample No. 4 having a copper-silver plating film with a thickness of 50 μm was obtained by carrying out electroplating in the same manner as in No. 2, except that N-acetyl-DL-methionine=10 g/L was added instead of thiourea as a complexing agent.

No. 5 (Example of the Present Invention)

Sample No. 5 having a copper-silver plating film with a thickness of 50 μm was obtained by carrying out electroplating in the same manner as in No. 2, except that DL-methionine sulfoxide=10 g/L was added instead of thiourea as a complexing agent.

For each of the above samples, the film appearances immediately after plating and after the heat treatment at 230° C. for 2 hours were visually observed and the following items were measured.

(1) Sulfur Content in the Film

The sulfur content (mass %) in the film was measured by energy dispersive X-ray spectrometry (EDS) using EDAX OCTANE PLUS manufactured by AMETEK Co., Ltd. The sulfur content in the plating film is shown in Table 1. The detection limit concentration in the above-mentioned measurement method is 0.2%.

(2) Crystal Structure

Using a focused ion beam (FIB) machining observation device (XVISION 210DB manufactured by Hitachi High-Technologies Corporation), a cross section perpendicular to the film thickness direction of the sample was exposed. Then, the cross section was observed with a scanning ion microscope (SIM) attached to the above-mentioned machining observation device. FIG. 3 shows the crystal structures after the heat treatment in Nos. 1 to 3.

(3) Tensile Strength

The tensile strength of the plating film was measured using Autograph AGS-X (manufactured by Shimadzu Corporation). Each measurement film was formed into a strip shape having a dimension of 5 cm×1.27 cm and a thickness of 50 μm. FIG. 4 shows the results of tensile tests immediately after plating and after the heat treatment in Nos. 1 and 3.

(4) Vickers Hardness

Using a Vickers hardness tester HM-124 (manufactured by Akashi Corporation), the hardness of the plating film was measured under the following conditions:

Load: 0.05 kg, holding time: 10 seconds, and film thickness: 50 μm.

These results are shown in Table 1.

TABLE 1

| Sample | | No. 1 | No. 2 | No. 3 | No. 4 | No. 5 |
|---|---|---|---|---|---|---|
| type of plating | | copper plating | copper-silver alloy plating | | | |
| complexing agent | | — | thiourea | DL-methionine | N-acetyl-DL-methionine | DL-methionine sulfoxide |
| sulfur content in the film (mass %) | | below detection limit | 1.87 | below detection limit | below detection limit | below detection limit |
| crystal structure | after heating at 230° C. for 2 hours | random orientation | amorphous structure | columnar structure | columnar structure | columnar structure |
| hardness (Hv) | just after plating | 185 | unmeasurabl because of a brittle film | 197 | 240 | 197 |

TABLE 1-continued

| Sample | | No. 1 | No. 2 | No. 3 | No. 4 | No. 5 |
|---|---|---|---|---|---|---|
| | after heating at 230° C. for 2 hours | 75 | unmeasurabl because of a brittle film | 200 | 235 | 195 |
| tensile strength (Mpa) | just after plating | 503 (51 kgf/mm$^2$) | unmeasurabl because of a brittle film | 495 (51 kgf/mm$^2$) | 510 (51 kgf/mm$^2$) | 495 (51 kgf/mm$^2$) |
| | after heating at 230° C. for 2 hours | 183 (19 kgf/mm$^2$) | unmeasurabl because of a brittle film | 479 (49 kgf/mm$^2$) | 501 (49 kgf/mm$^2$) | 480 (49 kgf/mm$^2$) |

First, the appearances of the copper-silver alloy plating film immediately after plating and after the heat treatment will be explained with reference to FIGS. 1 and 2. FIGS. 1 and 2 show photographs of the film appearances of No. 2 (the comparative example using thiourea as a complexing agent) and No. 3 (the example of the present invention using methionine as specified in the present invention as a complexing agent), respectively.

In No. 2, a glossy film was obtained immediately after plating as shown in FIG. 1(*a*). However, when this film was peeled off from the end part, the film crumbled and dropped from the Stainless steel plate as shown in FIG. 1(*b*). Furthermore, the film after the heat treatment further became brittle, and a part of the film was missing as shown in FIG. 1(*c*). From this result, it was revealed that when thiourea is used as a complexing agent, only a brittle film can be formed.

On the other hand, in No. 3, a film having good appearance was formed immediately after plating as shown in FIG. 2(*a*), and this film state was able to be maintained even after the heat treatment as shown in FIG. 2(*b*). Although not shown in the drawings, it was confirmed that films similar to the film of No. 3 were obtained also in the examples of the present invention of Nos. 4 and 5.

As for No. 1 (copper plating, the conventional example) to which an alloy component and a complexing agent were not added, although no photographs are shown in the drawings, a film having good appearance was formed immediately after plating. However, it was impossible to maintain this film state even after the heat treatment due to recrystallization by the heat treatment.

Next, the results of Nos. 1 to 5 will be described in detail with reference to Table 1, FIG. 3 and FIG. 4. FIG. 3 shows FIB-SIM photographs of the crystal structures of Nos. 1 to 3 after the heat treatment, and FIG. 4 shows graphs of the tensile test results of Nos. 1 and 3.

First, No. 1 will be considered. No complexing agent was added to the copper plating film of No. 1, and hence sulfur was hardly co-deposited in the plating film. Therefore, the hardness and the tensile strength immediately after plating were good. However, when the heat treatment was performed thereafter, the hardness and the tensile strength significantly decreased due to recrystallization by the heat treatment as compared with those immediately after plating (regarding the tensile strength, see FIG. 4(*a*)). That is, in copper plating, although sulfur embrittlement does not occur, there is a problem that the mechanical properties deteriorates due to recrystallization by heat treatment.

Next, No. 2 will be considered. By allowing silver to be co-deposited in the plating film as in No. 2, recrystallization after heat treatment can be suppressed (see FIG. 3). However, in No. 2, since thiourea was added as a complexing agent in order to allow silver to be co-deposited, sulfur was co-deposited in an amount of several % in the plating film, and sulfur embrittlement occurred. The heat treatment further promoted sulfur embrittlement. Therefore, a plating film that is excellent in hardness and strength was not obtained in No. 2.

Next, No. 3 will be considered. In No. 3, the crystal state immediately after plating was able to be maintained, and the film having columnar crystals was obtained (see FIG. 3). Furthermore, since methionine was used as a complexing agent in No. 3, the problem due to sulfur embrittlement was not observed even after the heat treatment, and a film excellent in hardness and strength was obtained not only immediately after plating but also after the heat treatment (regarding the tensile strength, see FIG. 4(*b*)).

Although not shown in the drawings, films having columnar crystals were obtained also in Nos. 4 and 5, and the satisfactory results similar to those in No. 3 were obtained as shown in Table 1.

The invention claimed is:

1. A copper electrolytic plating bath consisting of copper ions, an acid, chloride ions, and a complexing agent, wherein the copper electrolytic plating bath further consists of silver ions as an alloy component, wherein methionine or a derivative thereof is contained as the complexing agent, wherein the copper electrolytic plating bath has a concentration of copper ions in an amount of 5 to 90 g/L, and wherein the copper electrolytic plating bath optionally further consists of at least one selected from the group consisting of a complexing agent other than the methionine or the derivative thereof, a brightener, a carrier, a leveler, and a surfactant.

2. The copper electrolytic plating bath according to claim 1, wherein the copper electrolytic plating bath consists of the copper ions, the acid, the chloride ions, the complexing agent, the silver ions as the alloy component, and the at least one selected from the complexing agent other than the methionine or the derivative thereof, the brightener, the carrier, the leveler, and the surfactant.

3. The copper electrolytic plating bath according to claim 1, wherein the complexing agent consists of methionine or a derivative thereof.

* * * * *